US009280120B2

(12) United States Patent
Matsumoto

(10) Patent No.: US 9,280,120 B2
(45) Date of Patent: Mar. 8, 2016

(54) DECOLORIZING APPARATUS AND METHOD OF CONTROLLING HEAT SOURCE UNITS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Hirotaka Matsumoto, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 147 days.

(21) Appl. No.: 14/056,342

(22) Filed: Oct. 17, 2013

(65) Prior Publication Data

US 2015/0110537 A1 Apr. 23, 2015

(51) Int. Cl.

| | |
|---|---|
| ***G03G 15/00*** | (2006.01) |
| ***G03G 21/00*** | (2006.01) |
| ***B41M 7/00*** | (2006.01) |
| *B41M 5/30* | (2006.01) |

(52) U.S. Cl.

CPC ..... *G03G 15/6585* (2013.01); *B41M 7/0009* (2013.01); *G03G 21/00* (2013.01); *B41J 2202/37* (2013.01); *B41M 5/305* (2013.01)

(58) Field of Classification Search

CPC ..... B41J 2202/37; B41J 2/38; G03G 9/0926; G03G 15/6585

See application file for complete search history.

(56) References Cited

U.S. PATENT DOCUMENTS

| | | | | |
|---|---|---|---|---|
| 6,927,368 | B2 * | 8/2005 | Cao et al. | 219/492 |
| 2007/0059013 | A1 * | 3/2007 | Mori et al. | 399/69 |
| 2010/0128327 | A1 * | 5/2010 | Maeshima et al. | 358/474 |
| 2012/0189340 | A1 * | 7/2012 | Hagiwara | 399/82 |
| 2013/0242024 | A1 | 9/2013 | Iguchi | |

* cited by examiner

*Primary Examiner* — Judy Nguyen
*Assistant Examiner* — Jennifer Simmons
(74) *Attorney, Agent, or Firm* — Amin, Turocy & Watson, LLP

(57) ABSTRACT

A decolorizing apparatus includes first and second heating units, first and second heat source units, and a controller. The first and second heating units decolorize an image using decolorable colorants which are decolorized if heated. The first heating unit heats one surface of a sheet. The second heating unit heats a remaining surface which is opposite to the one surface of the sheet heated by the first heating unit. The first heat source unit heats the first heating unit. The second heat source unit heats the second heating unit. The controller includes a first mode and a second mode. In the first mode, the controller performs a decolorizing process on both the surfaces of the sheet by heating the first and second heating units using the first and second heat source units. In the second mode, the controller performs the decolorizing process on one surface of the sheet by heating the first heating unit using the first heat source unit, and heats the second heating unit using the second heat source unit with output which is lower than output acquired in the first mode.

8 Claims, 9 Drawing Sheets

FIG. 9

| | SECOND HEATING ROLLER | | LAMP LIGHTING AMOUNT (MAXIMUM LAMP LIGHTING TIME) | | FIRST HEATING ROLLER |
|---|---|---|---|---|---|
| MODE | DETECTION TEMPERATURE | CONTROL TEMPERATURE | FIRST HEATING LAMP | SECOND HEATING LAMP | CONTROL TEMPERATURE |
| SINGLE-SURFACE DECOLORIZING | DETECTION TEMPERATURE $X \geq Xa$°C (EMBODIMENT:145°C OR HIGHER) | REFERENCE TEMPERATURE B°C (EMBODIMENT: 140°C) | 100% (CONTROL ONLY FIRST LAMP) | 0% (CONTROL OF SECOND LAMP IS OFF) | REFERENCE TEMPERATURE C°C (EMBODIMENT: 160°C) |
| | DETECTION TEMPERATURE $Xa > X \geq Xb$°C (EMBODIMENT:130°C OR HIGHER AND 145°C OR LOWER) | REFERENCE TEMPERATURE B°C (EMBODIMENT: 140°C) | 85% (EMBODIMENT: 900 msec) | 15% (EMBODIMENT: 150 msec) | ↑ |
| | DETECTION TEMPERATURE $X < Xb$°C (EMBODIMENT:130°C OR LOWER) | REFERENCE TEMPERATURE B°C (EMBODIMENT: 140°C) | 75% (EMBODIMENT: 900 msec) | 25% (EMBODIMENT: 300 msec) | ↑ |
| DOUBLE-SURFACE DECOLORIZING | — | REFERENCE TEMPERATURE A°C (EMBODIMENT: 155°C) | 75% (EMBODIMENT: 900 msec) | 25% (EMBODIMENT: 300 msec) | ↑ |

DECOLORIZING APPARATUS AND METHOD OF CONTROLLING HEAT SOURCE UNITS

FIELD

Embodiments described herein relate generally to a technology for controlling heat source units of a decolorizing apparatus.

BACKGROUND

In recent years, images are formed on a sheet using decolorable colorants which are decolorized if heated. The sheet, on which the images are formed using such decolorable colorants, can be reused by decolorizing the images by heating the sheet using a decolorizing apparatus.

The decolorizing apparatus includes first and second heating units configured to come into contact with one surface and the other surface of a sheet and heat the respective surfaces, and first and second heat source units configured to heat the first and second heating units. Here, in the modes of the decolorizing apparatus, it is considered that a double-surface decolorizing mode and a single-surface decolorizing mode are set. Here, in a case of the double-surface decolorizing mode, it is considered that both the surfaces of a sheet are decolorized using the first and second heating units while simultaneously heating both the first and second heating units.

On the other hand, in a case of the single-surface decolorizing mode, it is considered that the decolorizing target surface of the sheet is decolorized while heating only a heating unit which corresponds to the decolorizing target surface of the sheet. If so, the heating unit which corresponds to the non-decolorizing target surface of the sheet is not heated in the case of the single-surface decolorizing mode, and thus it is possible to save electric power as much as that.

However, in the decolorizing apparatus, it is necessary to enable a stable decolorizing process to be performed in addition to saving of an electric power.

DESCRIPTION OF THE DRAWINGS

FIG. 9 is a view illustrating conditions for the control of the first and second heat source lamps.

DETAILED DESCRIPTION

In general, according to one embodiment, a decolorizing apparatus includes first and second heating units, first and second heat source units, and a controller. The first and second heating units decolorize an image using decolorable colorants which are decolorized if heated. The first heating unit heats one surface of a sheet. The second heating unit heats a remaining surface which is opposite to the surface of the sheet heated by the first heating unit. The first heat source unit heats the first heating unit. The second heat source unit heats the second heating unit. The controller includes a first mode and a second mode. In the first mode, the controller performs a decolorizing process on both the surfaces of the sheet by heating the first and second heating units using the first and second heat source units. In the second mode, the controller performs the decolorizing process on one surface of the sheet by heating the first heating unit using the first heat source unit, and heats the second heating unit using the second heat source unit with output which is lower than output acquired in the first mode.

Generally, in an embodiment, there is provided a method of controlling heat source units using a decolorizing apparatus which includes first and second heating units that are used to decolorize an image using decolorable colorants which are decolorized if heated, the first heating unit heating one surface of a sheet and the second heating unit heating a remaining surface which is opposite to the one surface of the sheet heated using the first heating unit, and first and second heat source units that heat the first and second heating units. The method of controlling heat source units includes: setting any one of a first mode and a second mode; in the first mode, performing a decolorizing process on both the surfaces of the sheet by heating the first and second heating units using the first and second heat source units; and, in the second mode, performing the decolorizing process on the one surface of the sheet by heating the first heating unit using the first heat source unit, and heating the second heating unit using the second heat source unit with output which is lower than output acquired in the first mode.

Hereinafter, embodiments will be described with reference to the accompanying drawings.

Figure 1:
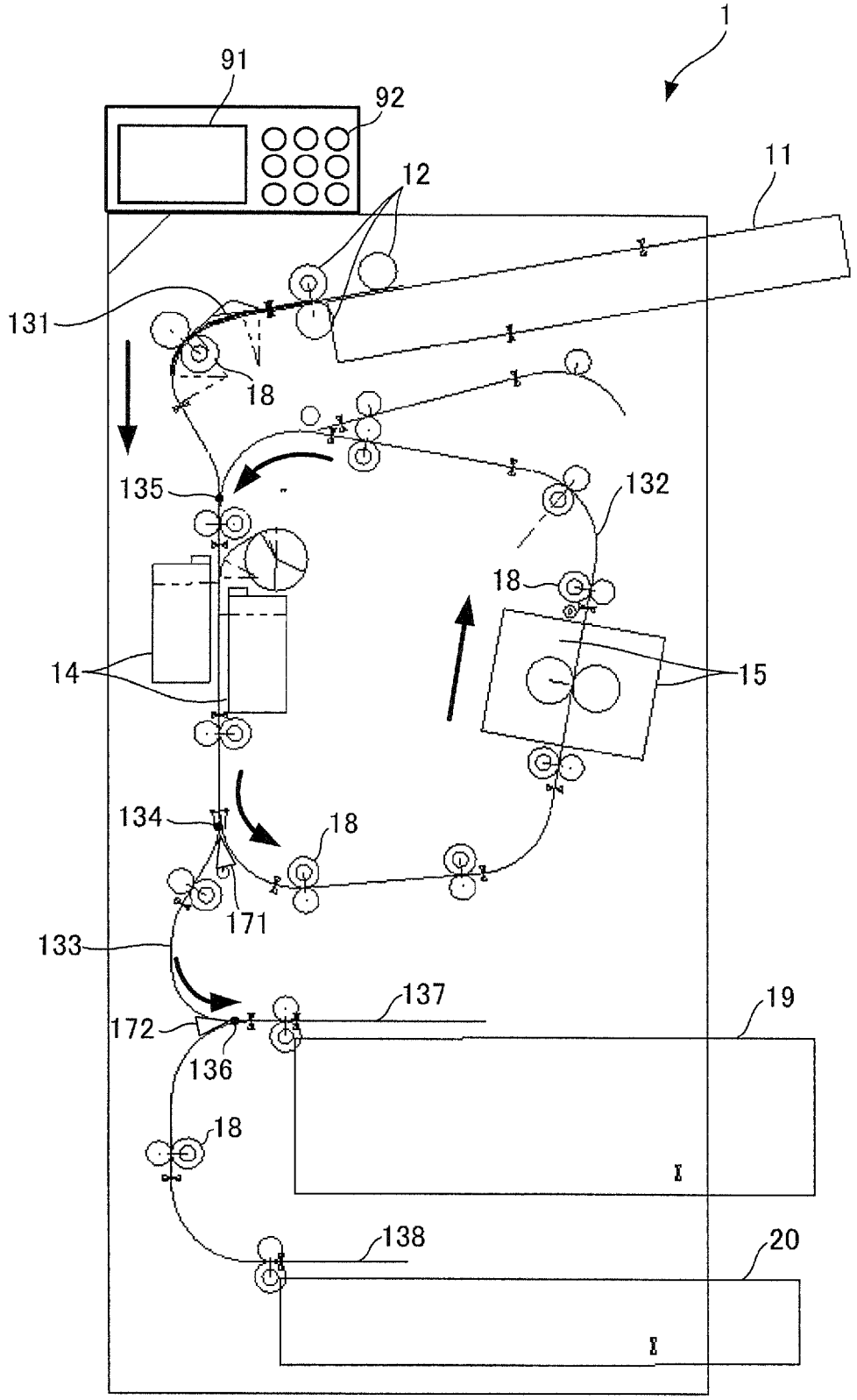
FIG. 1 is a whole configuration diagram illustrating a decolorizing apparatus.

FIG. 1 is a whole configuration diagram illustrating a decolorizing apparatus 1.

The decolorizing apparatus 1 performs a decolorizing process of decolorizing the colors of images on a sheet on which the images are formed using a decolorable toner or decolorable colorants, such as decolorable ink. The decolorable colorants include color developing compound, a color developer, and a decolorizing agent. The color developing compound may include, for example, leuco dye which is colored in blue. The color developer may include, for example, phenol. The decolorizing agent may include a material which is compatible with the color developing compound when being heated and which does not include affinities with color developer. The decolorable colorants are colored through interaction between the color developing compound and the color developer, and decolorized in such a way that the mutual interaction between the color developing compound and the color developer is disconnected by heating the decolorable colorants at a temperature which is equal to or greater than a decolorizing temperature.

Figure 3:
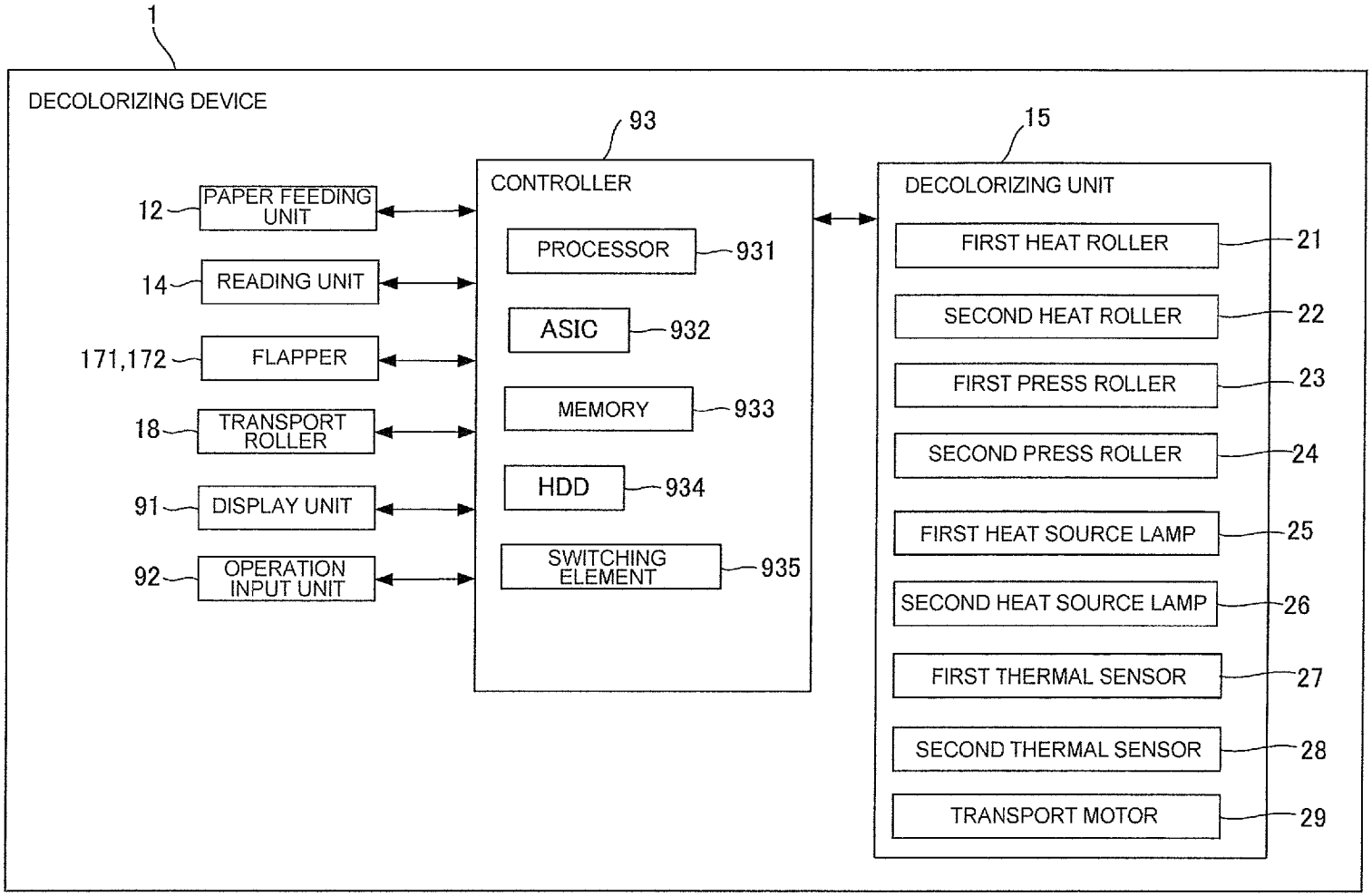
FIG. 3 is a block diagram illustrating the hardware configuration of the decolorizing apparatus.

The decolorizing apparatus 1 includes a paper feeding tray 11, a paper feeding unit 12, first to third transport paths 131 to 133, a reading unit 14, a decolorizing unit 15, flappers 171 and 172, a transport roller 18, a reuse tray 19, a reject tray 20, a display unit 91, an operation input unit 92, and a controller 93 (FIG. 3).

The sheet on which the images are formed using decolorable colorants is placed on the paper feeding tray 11. When the images are formed using the decolorable colorants on only one surface of the sheet, the paper feeding tray 11 contains the sheet while the surface (first surface) faces up.

The paper feeding unit 12 feeds the sheets placed on the paper feeding tray 11 to the first transport path 131 one by one.

The reading unit 14 is arranged along the first transport path 131. The reading unit 14 includes a Charge Coupled Device (CCD) and reads the images on both the surfaces (the first surface and a second surface) of the sheet before decolorizing is performed.

The second transport path 132 branches from the first transport path 131 at the branching point 134 of the first transport path 131, and is joined to the first transport path 131 at a joint point 135 which is upstream from the reading unit 14 in the sheet transport direction. The third transport path 133 branches from the branching point 134. A first branch path 137 and a second branch path 138 branch from the branching point 136 of the third transport path 133.

The decolorizing unit 15 is arranged along the second transport path 132. The decolorizing unit 15 performs the decolorizing process on the images which are formed on either both the surfaces or the single surface of the sheet by heating either both the surfaces or the single surface of the sheet.

The display unit 91 is a touch panel on the like.

The operation input unit 92 includes buttons or keys, and receives operation input from a user.

Figure 2:
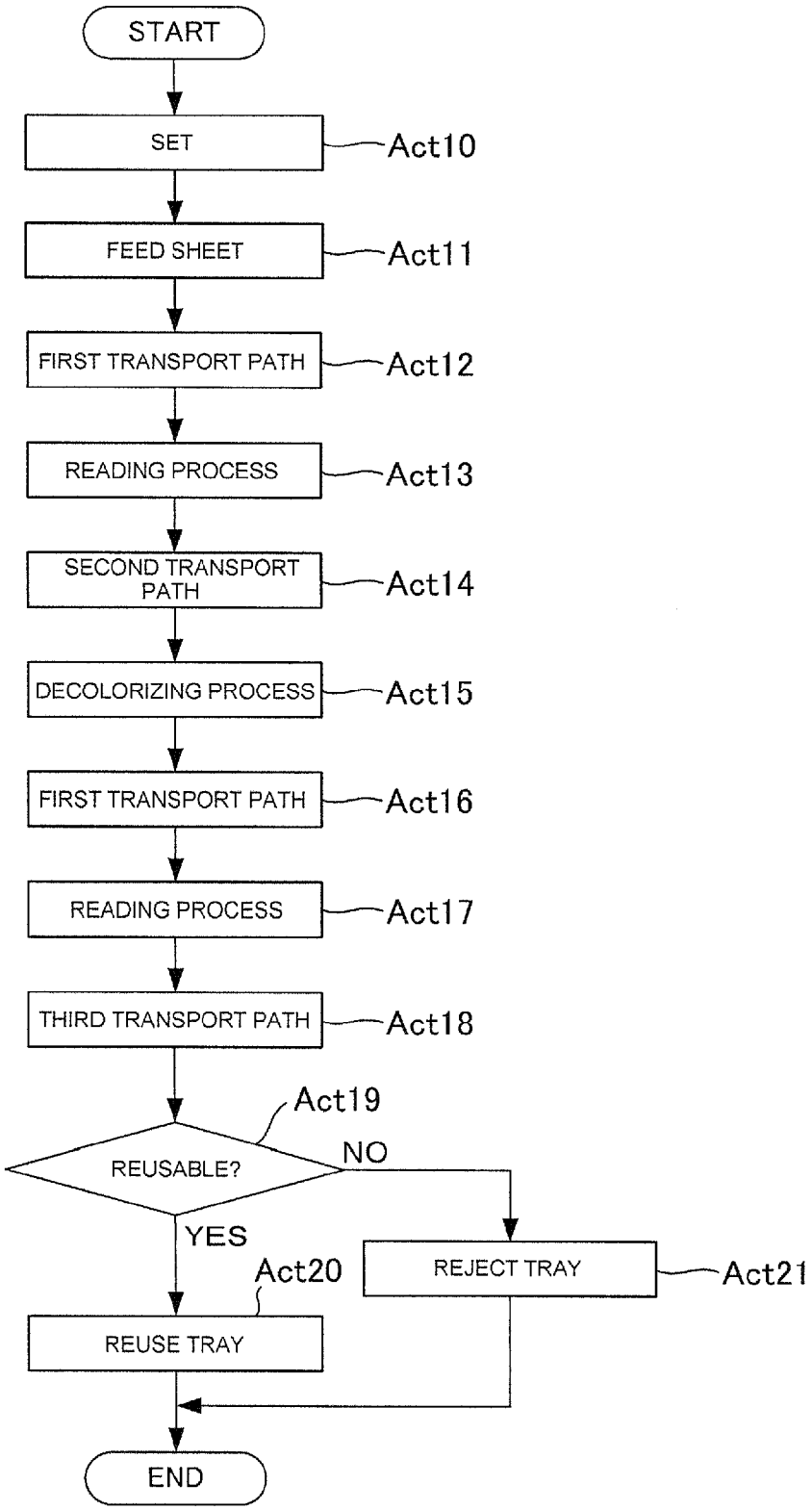
FIG. 2 is a flowchart illustrating the concept of a decolorizing process performed by a controller.

Hereinafter, the concept of the decolorizing process performed by the controller 93 will be described with reference to FIG. 1 and a flowchart in FIG. 2 in brief.

The controller 93 includes a double-surface decolorizing mode (first mode) in which both the surfaces of a sheet are decolorized and a single-surface decolorizing mode (second mode) in which the single surface of the sheet is decolorized as decolorizing process modes.

The controller 93 receives input from the user using the operation input unit 92, and sets the decolorizing process mode to any one of the double-surface decolorizing mode and the single-surface decolorizing mode (Act 10). Meanwhile, the double-surface decolorizing mode may be set to default and the single-surface decolorizing mode may be set by the input from the user.

The controller 93 fetches a sheet on at least one surface thereof on which images are formed, from the paper feeding tray 11 using the paper feeding unit 12 (Act 11), and feeds the sheet to the first transport path 131 (Act 12).

The controller 93 reads the sheet using the reading unit 14, and outputs read image data to an HDD 934 (FIG. 3) (Act 13). Therefore, the user can acquire the image data of the sheet from the HDD 934 before the decolorizing is performed.

The controller 93 transports the sheet through the second transport path 132 (Act 14), and decolorizes the images on the sheet using the decolorizing unit 15 (Act 15). At this time, the controller 93 changes control which is performed on the decolorizing unit 15 in accordance with setting of the decolorizing process mode, and the details thereof will be described later.

The controller 93 transports the sheet through the first transport path 131 (Act 16), and reads the sheet again using the reading unit 14 (Act 17).

The controller 93 transports the sheet from the first transport path 131 to the third transport path 133, causes the sheet to wait in the first branch path 137 which precedes a branching point (Act 18), and determines whether or not the sheet can be reused based on the image data of the sheet acquired after decolorizing is performed (Act 19).

When it is determined that the sheet acquired after decolorizing is performed can be reused (Act 19: YES), the controller 93 discharges the sheet from the first branch path 137 to the reuse tray 19 without change (Act 20). When it is determined that the sheet cannot be reused because there is a defective image on the sheet (decoloring residue) or the like (Act 19: NO), the controller 93 performs switchback transport of the sheet from the first branch path 137 to the second branch path 138 and then discharges the sheet from the second branch path 138 to the reject tray 20 (Act 21).

FIG. 3 is a block diagram illustrating the hardware configuration of the decolorizing apparatus 1.

The controller 93 includes a processor 931, an Application Specific Integrated Circuit (ASIC) 932, a memory (storage unit) 933, a Hard Disk Drive (HDD, storage unit) 934 and a switching element 935, and controls the whole decolorizing apparatus 1.

The processor 931 implements various functions by executing programs which are stored in the memory 933 or the HDD 934. The memory 933 is a semiconductor memory, and includes a Read Only Memory (ROM) which stores various control programs, and a Random Access Memory (RAM) which provides a temporal operating area to the processor 931. The ROM stores various temperatures and conditions which are used for the control of first and second heat source lamps 25 and 26 of the decolorizing unit 15. The ASIC 932 is a dedicated circuit for implementing a specific function, and may include an appropriate function implemented by the processor 931.

The switching element 935 will be described later.

Figure 4:
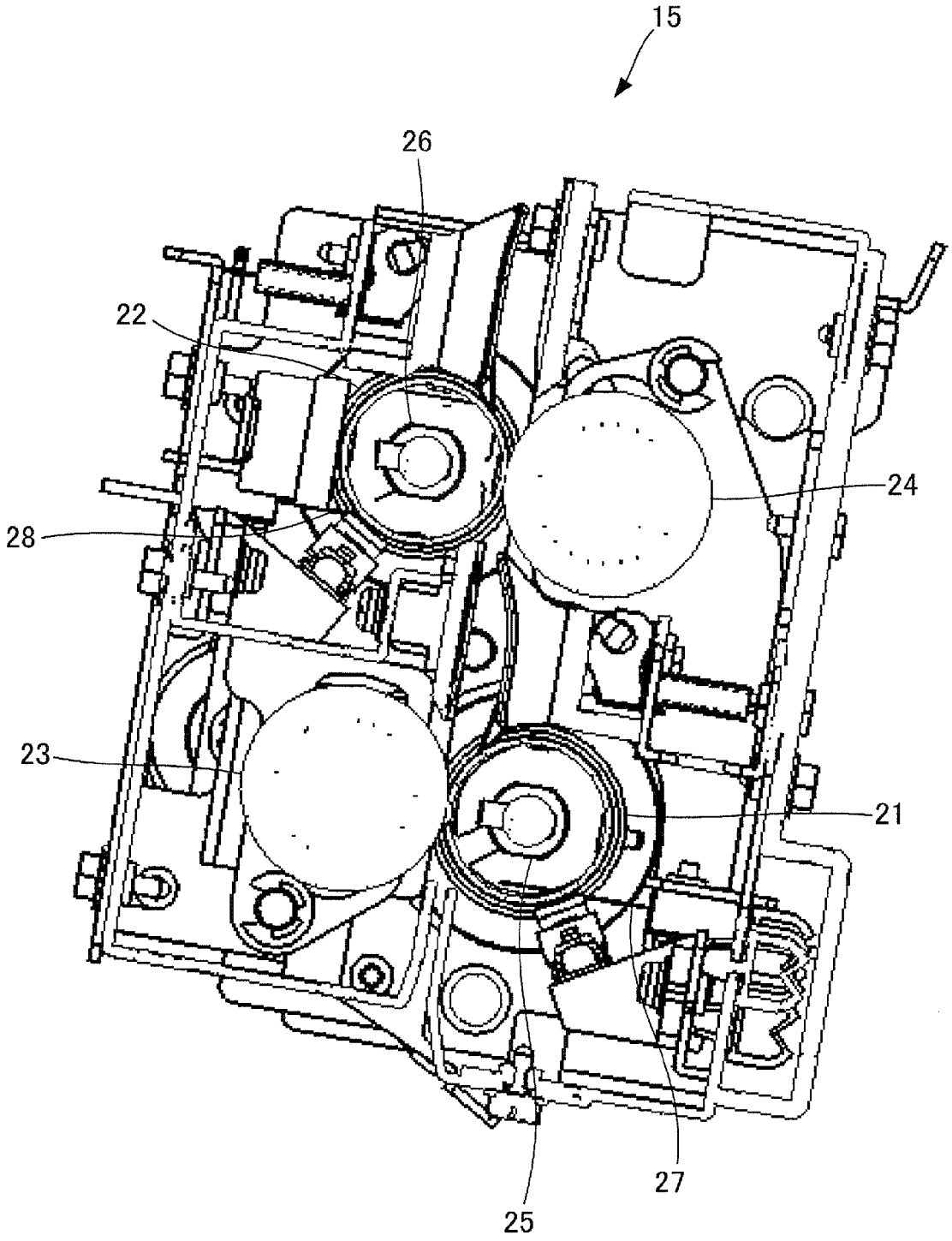
FIG. 4 is a view illustrating the configuration of a decolorizing unit.

FIG. 4 is a view illustrating the configuration of the decolorizing unit 15.

The decolorizing unit 15 includes first and second heating rollers 21 and 22, first and second press rollers 23 and 24, the first and second heat source lamps 25 and 26 (first and second heat source units), first and second thermal sensors 27 and 28, and a transport motor 29.

The first heating roller 21 is commonly used when the single-surface decolorizing process and the double-surface decolorizing process are performed. The first heating roller 21 decolorizes images on the first surface by heating the first surface of a sheet which comes on the upper side of paper feeding tray 11.

The second heating roller 22 is used only when the double-surface decolorizing process is performed and is positioned downstream from the first heating roller 21. The second heating roller 22 decolorizes images on the second surface by heating the second surface (surface which comes to the lower side of the paper feeding tray 11) which is opposite to the first surface of the sheet heated by the first heating roller 21.

The first and second press rollers 23 and 24 face the first and second heating rollers 21 and 22, and come into pressure contact with the first and second heating rollers 21 and 22.

The first and second heating rollers 21 and 22 heat the sheet while transporting the sheet interposed between the first and second heating rollers 21 and 22 and the first and second press rollers 23 and 24, and decolorize the images formed on the sheet.

The first and second heat source lamps 25 and 26 are halogen lamps which are included in the respective first and second heating rollers 21 and 22, and are configured to heat the first and second heating rollers 21 and 22.

In the embodiment, the diameter of the first heating roller 21 is 20 mm, the diameter of the first press roller 23 is 40 mm, and the first heat source lamp 25 is provided with 700 W. The diameter of the second heating roller 22 is 20 mm, the diameter of the second press roller 24 is 30 mm, and the second heat source lamp 26 is provided with 600 W.

The first and second thermal sensors 27 and 28 are contact type sensors using, for example, a thermistor, and detect the temperatures of the first and second heating rollers 21 and 22.

The transport motor 29 drives the rotation of the first and second heating rollers 21 and 22 and the first and second press rollers 23 and 24.

The above-described switching element 935 (FIG. 2) can supply electric power to the first heat source lamp 25 when being turned on, and is capable of supplying electric power to the second heat source lamp 26 when being turned off. The controller 93 is capable of controlling the outputs of the first and second heat source lamps 25 and 26 by performing Pulse Width Modulation (PWM) control in which the switching element is turned on or off. In addition, the controller 93 is capable of simultaneously lighting the first and second heat source lamps 25 and 26 without performing the PWM control.

When warming-up is performed, the controller 93 performs simultaneous lighting control on the first and second heat source lamps 25 and 26 in order to improve the operability of the decolorizing apparatus 1 by shortening warming-up time. When the decolorizing process or a wait operation is performed, electric power is used to drive the transport system motor, and thus the amount of electric power which can be used for the first and second heat source lamps 25 and 26 is limited. Therefore, when the decolorizing process or the wait operation is performed, the controller 93 performs the PWM control in which the first and second heat source lamps 25 and 26 are alternately lighted without simultaneously lighting the first and second heat source lamps 25 and 26.

In addition, the controller 93 performs feedback control on the first and second heat source lamps 25 and 26 based on the outputs of the first and second thermal sensors 27 and 28 such that the temperatures of the first and second heating rollers 21 and 22 are close to target temperatures.

Figure 5:
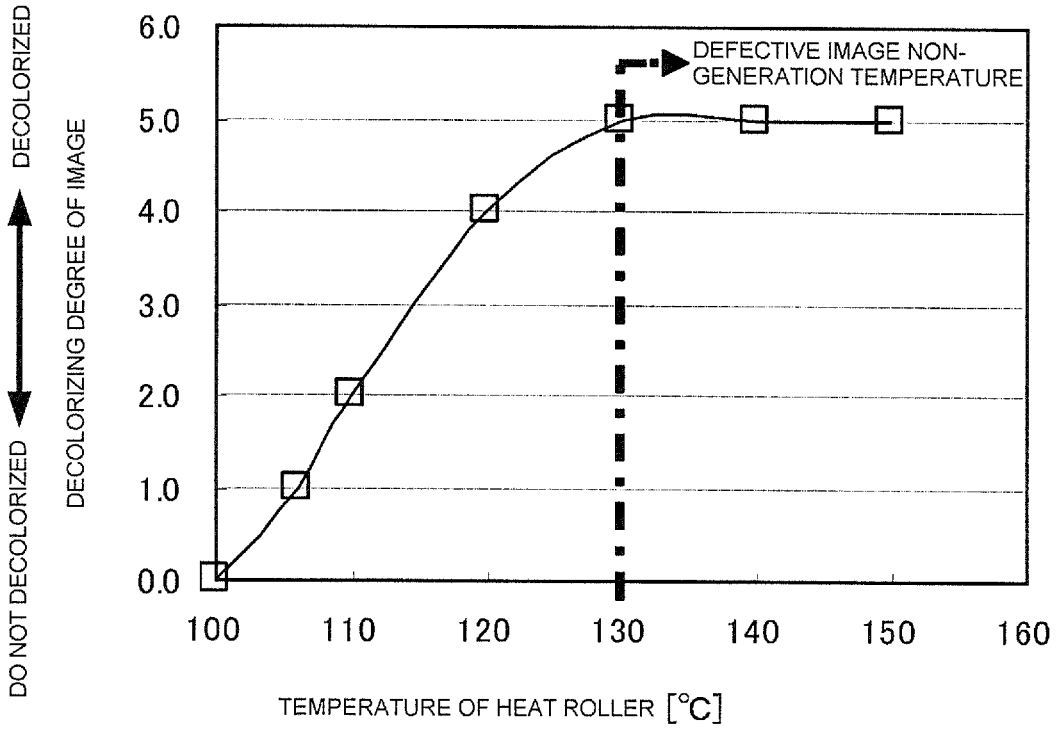
FIG. 5 is a view illustrating the relationship between the temperature of a heat roller and the decolorizing degree of an image.

FIG. 5 is a view illustrating the relationship between the temperatures of the heating rollers and the decolorizing degree of images.

As shown in FIG. 5, if the temperatures of the heating rollers are not heated at a predetermined temperature or higher when the decolorizing process is performed, images are not completely decolorized and a defective image (decoloring residue or uneven decolorizing) is generated. Hereinafter, a temperature in which a defective image is not generated is described as a defective image non-generation temperature. In the embodiment, the defective image non-generation temperature is 130° C.

Figure 6:
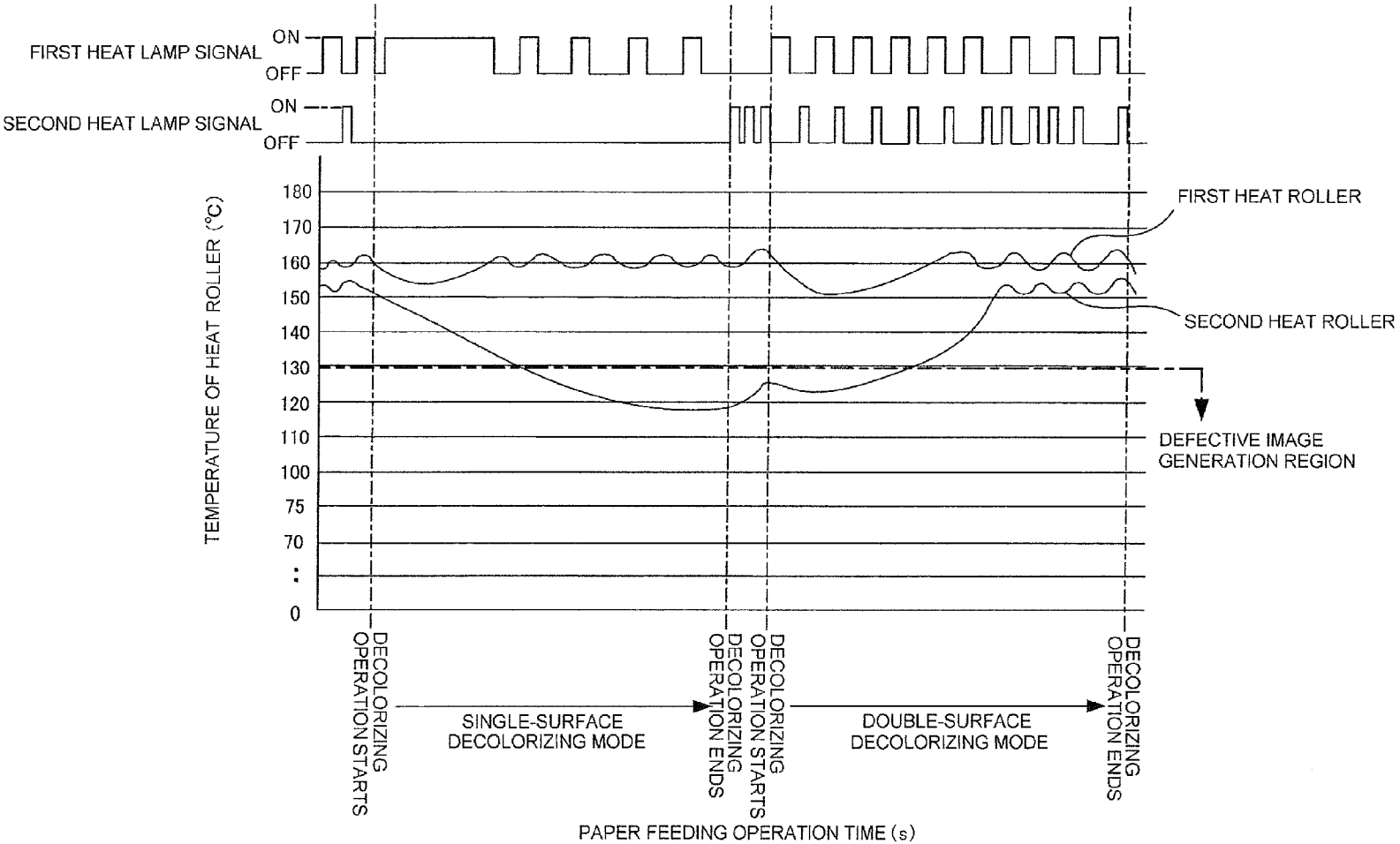
FIG. 6 is a view illustrating variation in the temperatures of first and second heating rollers when the second heating roller is not heated in a case of a single-surface decolorizing mode.

FIG. 6 is a view illustrating change in temperatures of the first and second heating rollers 21 and 22 when the second heating roller 22 is not heated in the single-surface decolorizing mode.

A case is considered in which a target temperature of the first heating roller 21 is 160° C. and a target temperature of the second heating roller 22 is 155° C. in the double-surface decolorizing mode and in which the second heating roller 22 is not heated in the single-surface decolorizing mode. In this case, in the beginning of the single-surface decolorizing mode, the temperature of the second heating roller 22 is close to the target temperature 155° C. However, when the sheet passes through the second heating roller 22 and the heat of the second heating roller 22 is taken away, the temperature of the second heating roller 22 drops below 130° C. which is the defective image non-generation temperature.

Even when the single-surface decolorizing mode is switched into the double-surface decolorizing mode and the second heating roller 22 is heated, the temperature of the second heating roller 22 does not reach the defective image non-generation temperature 130° C. for a while. Therefore, if the double-surface decolorizing operation of the decolorizing unit 15 starts when the single-surface decolorizing mode is switched into the double-surface decolorizing mode, the temperature of the second heating roller 22 drops below the defective image non-generation temperature 130° C., and a defective image is generated on the sheet.

Figure 7:
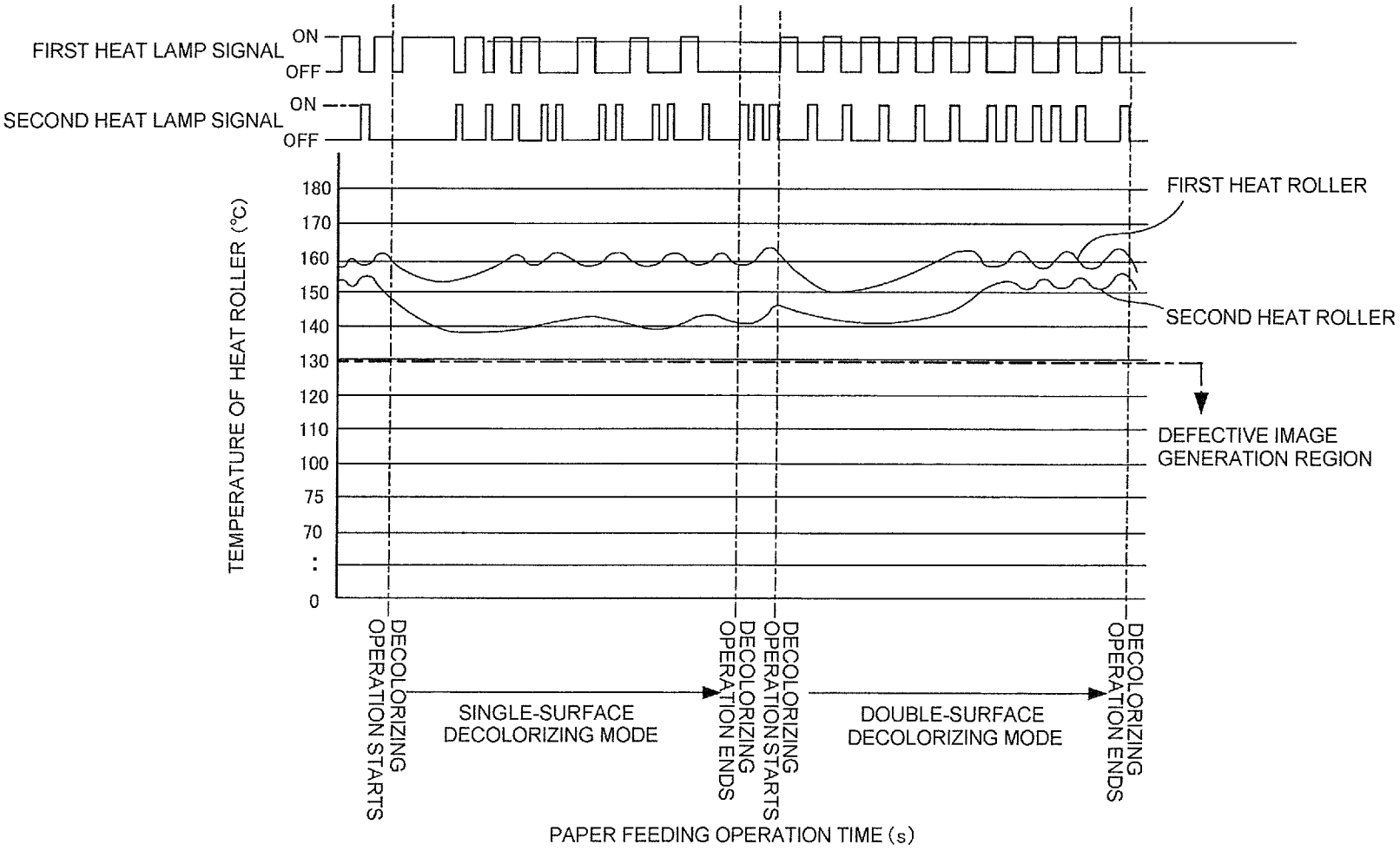
FIG. 7 is a view illustrating variation in the temperatures of the first and second heating rollers when a double-surface decolorizing process is performed after the single-surface decolorizing process is performed.

FIG. 7 is a view illustrating variation in the temperatures of the first and second heating rollers 21 and 22 when the double-surface decolorizing process is performed after the single-surface decolorizing process is performed in the embodiment.

In the embodiment, in the single-surface decolorizing mode, the controller 93 performs the decolorizing process on one surface of the sheet by heating the first heating roller 21 using the first heat source lamp 25, and heats the second heating roller 22 using the second heat source lamp 26 with output which is lower than the output acquired in the double-surface decolorizing mode.

More specifically, in the double-surface decolorizing mode, the controller 93 heats the first heating roller 21 by targeting a temperature 160° C. (first temperature) which is higher than the defective image non-generation temperature 130° C., and heats the second heating roller 22 by targeting a temperature 155° C. (second temperature) which is higher than the defective image non-generation temperature 130° C.

In addition, in the single-surface decolorizing mode, the controller 93 heats the first heating roller 21 by targeting a temperature 160° C. (third temperature) which is higher than the defective image non-generation temperature 130° C., and heats the second heating roller 22 by targeting a temperature 140° C. (fourth temperature) which is higher than the defective image non-generation temperature 130° C. and is lower than the second temperature 155° C. (second temperature) that is the target temperature in the double-surface decolorizing mode.

As described above, the controller 93 heats the second heating roller 22 at a temperature which is equal to or higher than the defective image non-generation temperature 130° C. in the single-surface decolorizing mode. In addition, in order to save electric power, the controller 93 heats the second heating roller 22 by targeting a temperature of 140° C., which is lower than the target temperature 155° C. in the double-surface decolorizing mode, in the single-surface decolorizing mode.

Therefore, in the embodiment, when the decolorizing unit starts the double-surface decolorizing operation, the temperature of the second heating roller 22 exceeds the defective image non-generation temperature 130° C., and thus it is possible to perform the stable decolorizing process by suppressing a defective image from being generated while electric power is saved.

Figure 8:
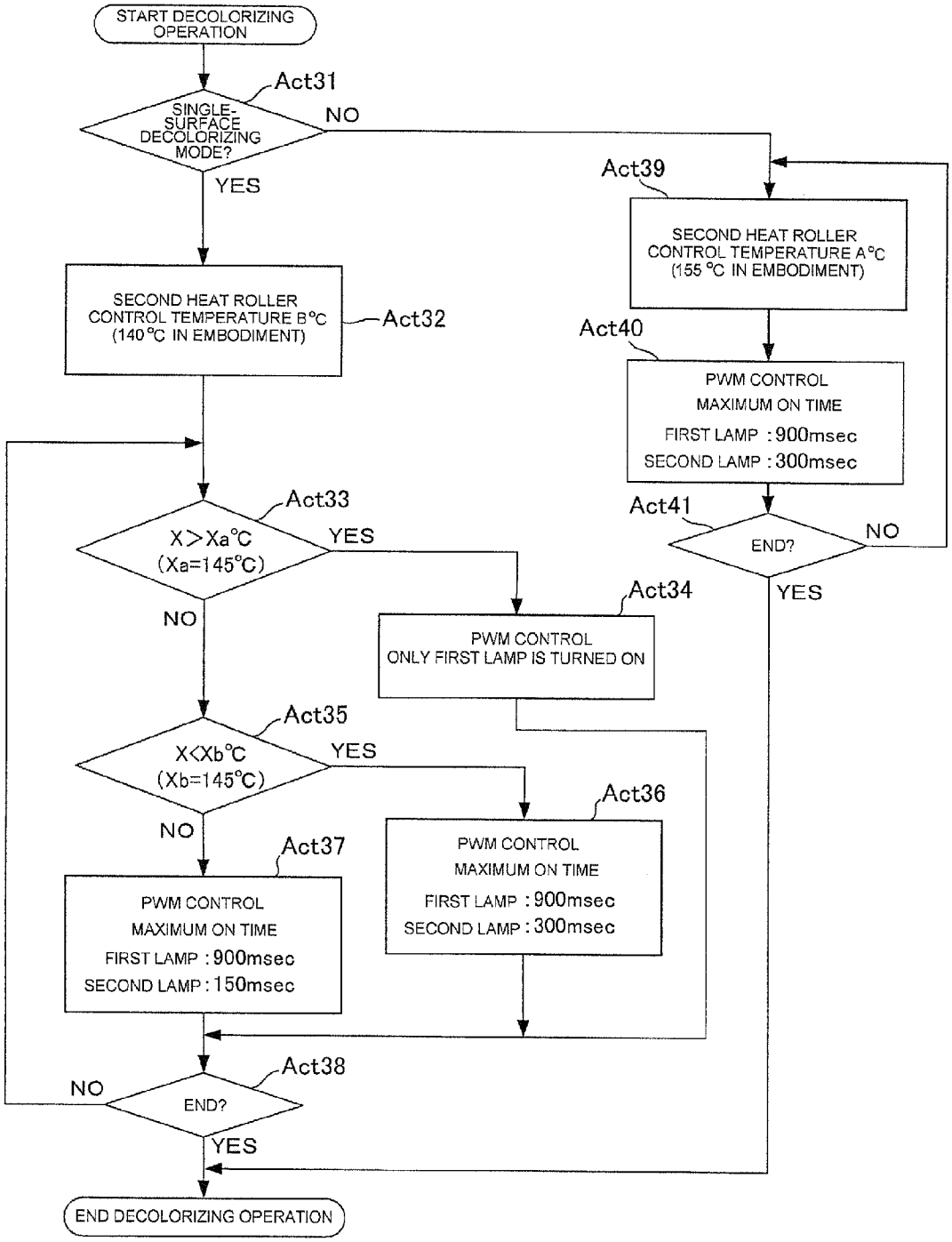
FIG. 8 is a flowchart illustrating a method of controlling first and second heat source lamps using a controller when a decolorizing operation starts.

Hereinafter, a method of controlling the first and second heat source lamps 25 and 26 using the controller 93 when the decolorizing operation starts will be described with reference to a flowchart in FIG. 8 and FIG. 9. FIG. 9 is a view illustrating conditions for the control of the first and second heat source lamps 25 and 26.

In the case of the single-surface decolorizing mode when the decolorizing operation starts (Act 31: YES), the controller 93 sets the target temperature of the first heating roller 21 to 160° C. and sets the target temperature of the second heating roller 22 to 140° C. (Act 32). Further, the controller 93 performs the PWM control in which the first and second heat source lamps 25 and 26 are alternately lighted such that the temperatures of the first and second heating rollers 21 and 22 are close to the respective target temperatures (reference temperatures) based on the temperatures of the first and second heating rollers 21 and 22 which are detected by the first and second thermal sensors 27 and 28.

More specifically, when the temperature of the second heating roller 22 is equal to or higher than 145° C. (Act 33: YES), the controller 93 outputs electric power only to the first heat source lamp 25 such that the temperature of the first heating roller 21 is close to the target temperature 160° C. (Act 34).

When the temperature of the second heating roller 22 is equal to or higher than 130° C. and lower than 145° C. (Act 33: NO and Act 35: YES), the controller 93 performs the PWM control such that the temperature of the first heating roller 21 is close to the target temperature 160° C. and the temperature of the second heating roller 22 is close to the target temperature 140° C. At this time, the controller 93 sets a duty ratio, which indicates the ON or OFF time of the switching element 935, to 85:15, sets the ON time that is output time to the first heat source lamp 25 in a single cycle to maximally 900 msec, and sets an OFF time that is output time to the second heat source lamp 26 in the single cycle to maximally 150 msec (Act 36).

When, the temperature of the second heating roller 22 is lower than 130° C. (Act 35: NO), the controller 93 performs the PWM control in such a way that the target temperatures of the respective first and second heating rollers 21 and 22 are 160° C. and 140° C., that is, the same as in Act 36 but the duty ratio is set to a value which is different from the value in Act 36. That is, the controller 93 sets the duty ratio to 75:25, sets the maximum ON time in the single cycle for the first heat source lamp 25 to 900 msec, and sets the maximum OFF time in the single cycle for the second heat source lamp 26 to 300 msec (Act 37).

If the decolorizing process performed on the sheet which corresponds to the target of the decolorizing process ends in the single-surface decolorizing mode, the controller 93 ends the processes in Act 33 to Act 37 (Act 38: YES).

In the process, as shown in FIG. 7, although the temperature of the second heating roller 22 drops when the sheet passes through the second heating roller 22, the controller 93 performs feedback control on the temperature of the second heating roller 22 using the target temperature 140° C., and thus it is possible to maintain the second heating roller 22 such that the temperature thereof is equal to or higher than the defective image non-generation temperature 130° C.

Therefore, in the embodiment, when the single-surface decolorizing mode is switched into the double-surface decolorizing mode, it is possible to set the temperature of the second heating roller 22 to a temperature which is equal to or higher than the defective image non-generation temperature 130° C. from the beginning, and thus it is possible to rapidly and excellently perform double-surface decolorizing process.

In the case of the double-surface decolorizing mode when the decolorizing operation starts (Act 31: NO), the controller 93 sets the target temperature of the first heating roller 21 to 160° C., and sets the target temperature of the second heating roller 22 to 155° C. (Act 39). Further, the controller 93 performs the PWM control on the first and second heat source lamps 25 and 26 such that the temperatures of the first and second heating rollers 21 and 22 are close to the respective target temperatures. At this time, the controller 93 sets the duty ratio to 75:25, sets the maximum ON time of the first heat source lamp 25 in a single cycle to 900 msec, and sets the maximum OFF time of the second heat source lamp 26 in a single cycle to 300 msec (Act 40).

If the decolorizing process performed on the sheet which corresponds to the target of the decolorizing process ends in the double-surface decolorizing mode, the controller 93 ends the processes in Act 39 and Act 40 (Act 41: YES).

Modification Example

The decolorizing apparatus 1 may not include the reading unit 14. In this case, the decolorizing unit 15 may be positioned in the first transport path 131.

The heating unit may not be a heating roller, and may be a surface-shaped heater which is capable of coming into contact with the surface of a sheet.

The order of each process in the embodiment may be different from the order exemplified in the embodiment.

As described above, according to the technology described in the specification, it is possible to provide a technology of controlling a heat source unit of a decolorizing apparatus.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. A decolorizing apparatus comprising:

first and second heating units that are used to decolorize an image using decolorable colorants which are decolorized if heated, the first heating unit heating one surface of a sheet and the second heating unit heating a remaining surface which is opposite to the one surface of the sheet heated using the first heating unit;

a first heat source unit that heats the first heating unit, and a second heat source unit that heats the second heating unit;

a switching element that supplies electric power to one of the first and second heat source units when being turned on, and supplies electric power to the other of the first and second heat source units when being turned off; and a controller that includes a first mode and a second mode which are set when a first decolorizing process and a second decolorizing process are performed, performs the first decolorizing process on both the surfaces of the sheet by heating the first and second heating units using the first and second heat source units by targeting a first temperature of the second heat source unit in the first mode, and performs the second decolorizing process on one surface of the sheet by heating the first heating unit using the first heat source unit, and heats the second heating unit using the second heat source unit by targeting a second temperature of the second heat source unit which is lower than the first temperature in the second mode, the controller controls the outputs of the first and second heat source units using Pulse Width Modulation control in which the switching element is turned on or off in the first and second modes, the controller simultaneously supplies electric power to the first and second heat source units and controls the first and second heat source units when warming-up is performed.

2. The apparatus according to claim 1, wherein the controller, in the second mode, heats the second heating unit using the second heat source unit at a temperature which is equal to or higher than a defective image non-generation temperature in which a defective image is not generated when the decolorizing process is performed on the remaining surface of the sheet using the second heating unit.

3. The apparatus according to claim 2, further comprising:

first and second thermal sensors that detect temperatures of the first and second heating units, wherein, based on outputs of the first and second thermal sensors, the controller in the first mode, heats the first heating unit by targeting a third temperature which is higher than the defective image non-generation temperature, and heats the second heating unit by targeting a first temperature which is higher than the defective image non-generation temperature, and in the second mode, heats the first heating unit by targeting a fourth temperature which is higher than the defective image non-generation temperature, and heats the second heating unit by targeting a second temperature which is higher than the defective image non-generation temperature and lower than the first temperature.

4. The apparatus according to claim 3, wherein the first temperature is lower than the third temperature and the second temperature is lower than the fourth temperature.

5. A method of controlling heat source units using a decolorizing apparatus which includes first and second heating units that are used to decolorize an image using decolorable colorants which are decolorized if heated, the first heating unit heating one surface of a sheet and the second heating unit heating a remaining surface which is opposite to the one surface of the sheet heated using the first heating unit, first and second heat source units that heat the first and second heating units, and a switching element that supplies electric power to one of the first and second heat source units when being turned on, and supplies electric power to the other of the first and second heat source units when being turned off, the method comprising:

setting a first mode or a second mode when a first decolorizing process or a second decolorizing process are performed:

in the first mode, performing the first decolorizing process on both surfaces of the sheet by heating the first and second heating units using the first and second heat source units by targeting a first temperature of the second heating unit;

in the second mode, performing the second decolorizing process on the remaining surface of the sheet by heating the first heating unit using the first heat source unit, and heating the second heating unit using the second heat source unit by targeting a second temperature of the second heating unit which is lower than the first temperature;

controlling the output of the first and second heat source units using Pulse Width Modulation control in which the switching element is turned on or off in the first and second modes; and simultaneously supplying electric power to the first and second heat source units and controlling the first and second heat source units when warming-up is performed.

6. The method according to claim 5, further comprising:

in the second mode, heating the second heating unit using the second heat source unit at a temperature which is equal to or higher than a defective image non-generation temperature in which a defective image is not generated when the decolorizing process is performed on the remaining surface of the sheet using the second heating unit.

7. The method according to claim 6, wherein the decolorizing apparatus further includes first and second thermal sensors that detect temperatures of the first and second heating units, and wherein the method further comprises:

based on outputs of the first and second thermal sensors, in the first mode, heating the first heating unit by targeting a third temperature which is higher than a defective image non-generation temperature, and heating the second heating unit by targeting a first temperature which is higher than the defective image non-generation temperature; and in the second mode, heating the first heating unit by targeting a fourth temperature which is higher than the defective image non-generation temperature, and heating the second heating unit by targeting a second temperature which is higher than the defective image non-generation temperature and lower than the first temperature.

8. The method according to claim 7, wherein the first temperature is lower than the third temperature and the second temperature is lower than the fourth temperature.

* * * * *